US006003608A

United States Patent [19]

Cunningham

[11] Patent Number: 6,003,608

[45] Date of Patent: Dec. 21, 1999

[54] FIRE SUPPRESSION SYSTEM FOR AN ENCLOSED SPACE

[75] Inventor: James A. Cunningham, Bellrose, N.Y.

[73] Assignee: Fail Safe Safety Systems, Inc., New York, N.Y.

[21] Appl. No.: 08/986,839

[22] Filed: Dec. 8, 1997

[51] Int. Cl.[6] ..... A62C 2/00; A62C 3/00

[52] U.S. Cl. ..... 169/46; 169/61

[58] Field of Search ..... 169/46, 60, 61, 169/62

[56] References Cited

U.S. PATENT DOCUMENTS

| | | | |
|---|---|---|---|
| 3,465,827 | 9/1969 | Levy et al. . | |
| 3,486,562 | 12/1969 | Goodloe et al. . | |
| 3,753,466 | 8/1973 | Uematsu | 169/11 X |
| 4,351,394 | 9/1982 | Enk | 169/61 |
| 4,552,325 | 11/1985 | Bruensicke | 244/118.5 |
| 4,643,260 | 2/1987 | Miller | 169/46 |
| 4,646,848 | 3/1987 | Bruensicke | 169/62 |
| 4,646,993 | 3/1987 | Baetke | 244/129.2 |
| 4,726,426 | 2/1988 | Miller | 169/62 |
| 5,038,867 | 8/1991 | Hindrichs et al. | 169/62 |
| 5,183,116 | 2/1993 | Fleming | 169/43 |
| 5,211,246 | 5/1993 | Miller et al. . | |

*Primary Examiner*—Lesley D. Morris
*Attorney, Agent, or Firm*—Frishauf, Holtz, Goodman, Langer & Chick, P.C.; Robert P. Michal

[57] ABSTRACT

A fire suppression system for an enclosed space, such as a cargo hold of an aircraft includes a fire detector, a container for storing a non-combustible, non-reactive gas which will not support combustion, a valve for releasing the non-combustible gas from the container, the valve being actuated by the fire detector, nozzles disposed within the space for distributing the non-combustible gas released from the container in the enclosed space, and an operable gas purging door disposed so to permit the exhausting of air other than the non-combustible gas from the enclosed space. A second container for storing a fire extinguishing mixture including a fire extinguishing agent and a non-combustible, non-reactive gas which will not support combustion is included. The fire extinguishing mixture is introduced into the enclosed space after the air has been expelled from the enclosed space.

22 Claims, 1 Drawing Sheet

FIRE SUPPRESSION SYSTEM FOR AN ENCLOSED SPACE

BACKGROUND OF THE INVENTION

1. Field of the Invention

The present invention relates to fire suppression systems, and more particularly, to fire suppression systems for substantially airtight enclosed spaces.

2. Background Information

Enclosed area fire suppression methods such as those commonly used in aircraft may also be used elsewhere. Critical features of these fire suppression systems are reliability and self-sufficiency. However, in aircraft and similar settings, efforts to minimize bulk are also essential. This leads to long term efficiencies, including fuel savings in aircrafts (or other modes of transportation) and more work space or storage space when used in other environments. Sometimes the bulkiest component in a fire suppression system is the chemical or compound (i.e., extinguishant) used to extinguish the fire. As an example, this may be 300–400 pounds of Halon ($CBrF_3$) extinguishant in an aircraft system. Hence a difficult trade-off must sometimes be made between having an adequate fire suppression system and one that is not bulky.

A problem typically arises in connection with fires because the particular location of the fire is unpredictable. Thus, enclosed area methods of fire suppression conventionally provide a minimum concentration of extinguishment within the enclosed area. The methods which do this essentially involve thoroughly mixing an extinguishant and air in the compartment.

Instead of selecting water as the extinguishant, enclosed area fire suppression methods (for example, in aircraft) typically employ bromotrifluoromethane ("$CBrF_3$), or a related compound bromochlorodifluoromethane, sold commercially as "Halon". Maintaining a minimum concentration of $CBrF_3$ in a compartment presents a special problem when the concentration is maintained for prolonged periods. $CBrF_3$ is most practically stored in its liquid form under pressure. As pressure decreases during, for example, piping into the enclosed area, the $CBrF_3$ vaporizes. Within a system having conduits, this phase change is transient, and therefore it is difficult to achieve a steady state flow of the $CBrF_3$. Consequently, during a lengthy dispersion there is substantial waste of $CBrF_3$.

The state of the art of enclosed area fire suppression methods still concerns mixing extinguishants and air in the compartment. Many methods focus on mixing extinguishants with air in order to take advantage of the heavier-than-air characteristic of extinguishants. $CBrF_3$ in the gas phase is about five times denser than air. Thus, $CBrF_3$ descends through air, much as sand falls through water. The quantity of extinguishant which is required by conventional methods is unsatisfactorily large. Some prior fire suppression systems are discussed below.

Miller et al. (U.S. Pat. No. 5,211,246) concern a fire suppression method and system for use in an enclosed area, such as in the interior of an aircraft. Miller et al. disclose dispersing a fire retardant material in a layer across the top of an upper region of the enclosed area, while maintaining a sufficient concentration of the material to suppress any fire with which the layer comes into contact. The layer is permitted to descend from the upper region through the middle and lower regions of the enclosed area until the layer has settled near the floor. The descent of the fire retardant material in Miller et al. scours the entire area to suppress the fire.

Fleming (U.S. Pat. No. 5,183,116) is directed to a fire extinguishing discharge system which discharges a fire extinguishing material at a predetermined mass flow rate to maintain adequate concentration of fire extinguishing material in the space.

Hindrichs et al. (U.S. Pat. No. 5,036,867) relate to a fire protection system for extinguishing fires in the cargo space of an aircraft. The system includes two containers for providing extinguishing evaporating liquid, and a common conduit system with nozzles for distributing the liquid. The Hindrichs et al. system is specifically directed to preventing the fire extinguishing medium within the system from freezing (i.e., turning to a solid form).

Miller (U.S. Pat. No. 4,726,426) relates to a fire extinguishment system for an aircraft passenger cabin, wherein a fire extinguishment chemical is provided through the environmental control system of the aircraft.

Baetke (U.S. Pat. No. 4,646,993) is directed to sidewall vent valves for an aircraft. The sidewall vent valves are located in the deck of the aircraft between the skin of the aircraft fuselage and the sidewall panels to selectively prevent and permit fluid communication between an upper and lower compartment of an aircraft.

Bruensicke (U.S. Pat. No. 4,646,848) concerns a fire suppression system for an aircraft including a plurality of ducts which couple a plurality of sub-compartments of the aircraft. The ducts are arranged to distribute the fire suppression chemical in a specific pattern.

Miller (U.S. Pat. No. 4,643,260) discloses a fire suppression system including a first rapidly discharging Halon container (I) and a second metered discharging Halon container (II). The first container is discharged to insure a minimum enclosed compartment concentration of 5% Halon by volume for an initial flame knockdown. The discharge of the second bottle occurs when the Halon concentration as a result of the discharge of the first container drops to 3%. Miller teaches that the Halon gas is introduced near the ceiling at a controlled rate and the gas is dispersed uniformly throughout the cabin so that the location of the fire need not be known.

Bruensicke (U.S. Pat. No. 4,552,325) relates to an emergency smoke disposal system for pressurized aircraft wherein a normally closed smoke evacuation outlet in the skin of the aircraft is actuated to discharge smoke from the aircraft cabin. The evacuation outlet is oriented in an upper portion of the aircraft such that the smoke which accumulates at the top of the aircraft will escape.

Enk (U.S. Pat. No. 4,351,394) is directed to a fire protection system for use in aircraft including a manifold system for providing a fire extinguishing compound to a selected area.

Uematsu (U.S. Pat. No. 3,753,466) discloses an automatic fire extinguishing device for use in copying machines.

Goodloe et al. (U.S. Pat. No. 3,486,562) disclose an apparatus for detecting and extinguishing a fire in an enclosed environment, including a temperature sensor that is activated when a temperature threshold is reached. When the temperature sensor is activated, the gaseous contents of the enclosed area are evacuated to a second enclosed area (accumulator) which is at a substantially lower pressure than the enclosed environment. Substantially simultaneously, nitrogen is introduced into the enclosed environment from a bottom portion of the compartment to take the place of the gases which have been evacuated from the enclosed environment.

Levy et al. (U.S. Pat. No. 3,465,827) relate to an on-board vehicle fire protection system including an air duct opening into the passenger compartment coupled to a foam generating apparatus for providing foam into the passenger compartment.

None of the above discussed patents disclose, teach or suggest releasing a non-combustible gas (e.g., helium) in a substantially enclosed area which forces the gases (i.e., air) present in the enclosed area in either an upward or downward direction in order to effectively suffocate a fire, wherein a fire extinguishing mixture including a non-combustible gas and a fire extinguishing compound are introduced into the enclosed area, and wherein an actuatable gas purging door is opened which enables the air present in the enclosed space to be evacuated therefrom.

OBJECTS AND SUMMARY OF THE INVENTION

It is an object of the present invention to provide a fire suppression system which is safe and reliable for extinguishing fires that are present in a substantially enclosed space.

It is a further object of the present invention to provide a fire suppression system for use in a substantially enclosed space, which does not utilize water or $CBrF_3$ to extinguish the fire.

It is another object of the present invention to provide a fire suppression system which overcomes inherent disadvantages of known fire suppression systems.

In accordance with one embodiment of the present invention, a fire suppression system for a substantially enclosed space includes a fire detector for detecting the presence of a fire, a container for storing a non-combustible gas, a valve operably coupled to the container for selectably releasing the non-combustible gas from the container wherein said valve is actuated by the detector, nozzles operably coupled to the valve for receiving the non-combustible gas wherein the nozzles are disposed at one of an upper portion and a lower portion of the enclosed space, and an openable gas exit door disposed at a portion of the enclosed space which is distal with respect to the position of the nozzles to exhaust air from the enclosed space.

BRIEF DESCRIPTION OF THE DRAWING

For the purposes of illustrating the invention, there is shown in the drawing a form which is presently preferred. It is to be understood, however, that the present invention is not limited to the precise arrangements and instrumentalities depicted in the drawing.

The FIGURE is a schematic diagram of a fire suppression system of the present invention.

DETAILED DESCRIPTION OF THE PREFERRED EMBODIMENT

Figure 1:
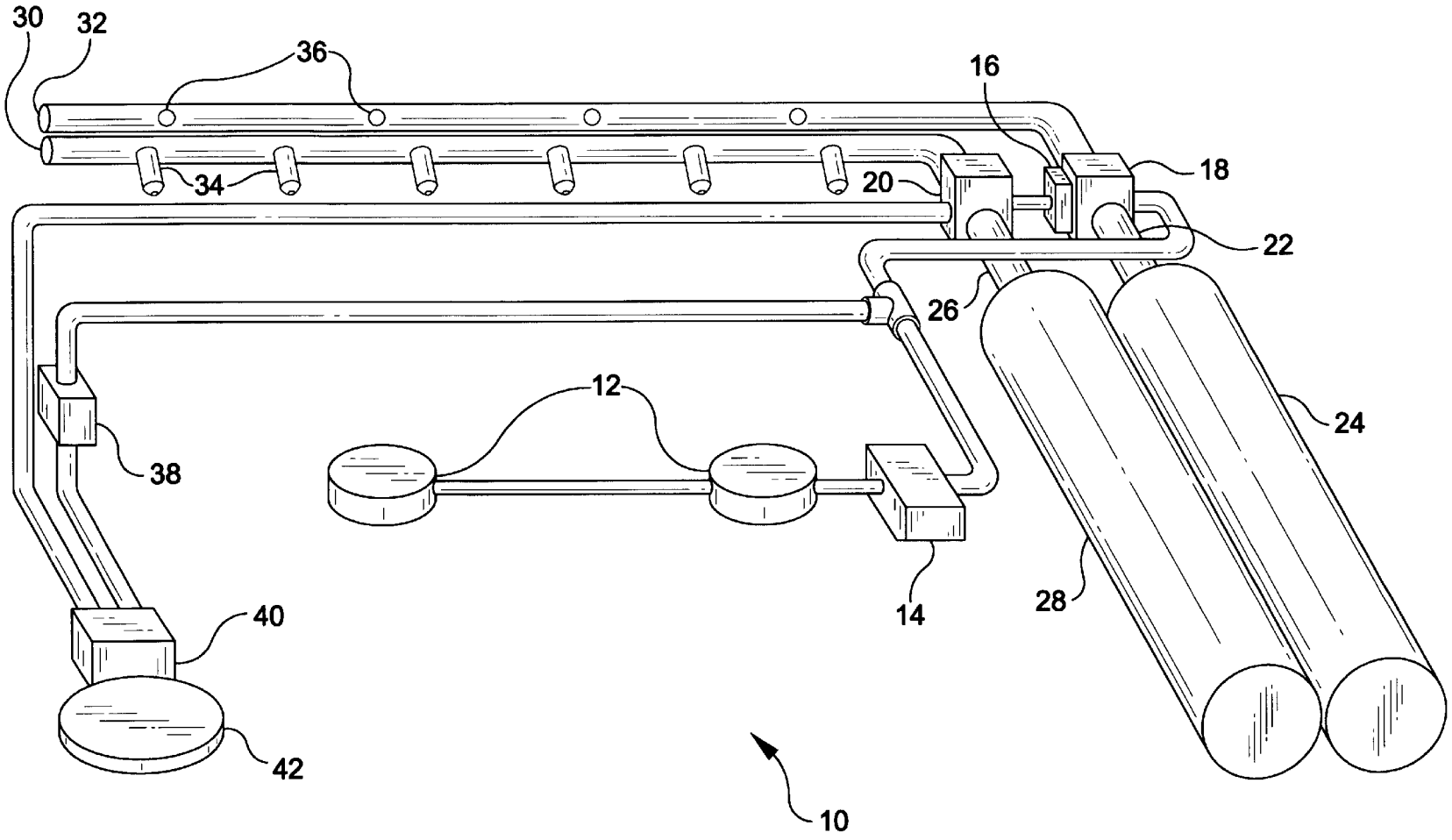

The fire suppression system 10 of the present invention is designed to extinguish a fire present in a confined, substantially airtight enclosed space, such as, for example, a cargo or similar area of an airplane or other means of transportation, a room that houses a computer mainframe or within a computer mainframe unit itself. An embodiment of the fire suppression system according to the present invention is depicted in the accompanying FIGURE.

In the FIGURE, fire detectors 12, which are preferably ionizing smoke detectors are electrically connected to a relay 14. While two detectors are shown in the FIGURE, two detectors need not be used. A sufficient number of detectors should be used and dispersed throughout the enclosed space to detect a fire soon after ignition occurs. Instead of smoke detectors, the fire detectors may instead detect heat (i.e., an increased temperature in the confined area), gaseous concentrations characteristic of the presence of fire or any other characteristic which would indicate the presence of a fire.

The relay 14 is electrically coupled to a sensor 16 and solenoid valves 18 and 20. The sensor 16 functions to monitor the pressure within container 24 and permits valve 18 to be opened when the pressure in container 24 falls to a predetermined level (described below). Solenoid valve 18 is operably fluidly coupled via conduit 22 to a container 24, which is preferably pressurized and contains a non-combustible, non-reactive gas which will not support combustion such as, for example, helium. An important feature of the non-combustible gas is that the gas will not support the existence of fire (i.e., fire will not continue if concentrations of the gas reach certain levels proximate the fire). Solenoid valve 20 is operably fluidly coupled via conduit 26 to container 28 which is preferably pressurized and contains a fire extinguishing mixture comprising a fire extinguishing agent (such as that disclosed in the application entitled Fire Extinguishing Composition and Method for Fire Extinguishing filed on the same day and identifying the same inventor as the present application, the disclosure of which is incorporated herein by reference) and a non-combustible, non-reactive gas which will not support combustion. The non-combustible gas used in container 28 need not be the same as the non-combustible gas used in container 24. However, the gases should be carefully selected such that the gases do not interact and have a non-desirable effect when both are introduced into the enclosed area.

The outlet of valve 20 is fluidly coupled to a misting nozzle manifold 30 and the outlet of valve 18 is coupled to a venting manifold 32. The misting nozzle manifold 30 contains a plurality of misting nozzles 34. The venting nozzle manifold 32 contains a plurality of venting nozzles 36. The misting nozzle manifold 30 and the venting manifold 32 are preferably disposed at an upper portion of the substantially air tight confined space. As a result, when a non-combustible gas (for example, helium) which is lighter than the air present in the confined space is released through the venting nozzles 36, the non-combustible gas will collect at the top of the space and displace air, forcing the air in a downward direction. The misting nozzle manifold 30 is preferably located at an upper portion of the space such that when the fire extinguishing mixture is released from the misting nozzles 34, the fire extinguishing agent will fall in a downward direction, likely encountering and extinguishing the fire. As a result at least one nozzle 34 should be disposed in a manner which will facilitate such downward flow of the fire extinguishing agent. In an alternative embodiment, it is foreseen that venting manifold 32 (which carries the non-combustible gas) having venting nozzles 36 may be disposed at a lower portion of the confined space. As a result, the non-combustible gas which is lighter than the air will rise to the top portion of the confined space to displace air and force the air to collect in the lower portion of the enclosed space.

The relay 14 is also electronically coupled to a timer 38. The timer 38 is electrically coupled to a motor-gear assembly 40 (or solenoid) for opening purging door 42 after a predetermined period of time has elapsed after the non-combustible gas from container 24 has been completely introduced into the enclosed space. The purging door 42 is normally in the closed position to preserve the substantially airtight conditions in the confined space. The purging door selectively operably couples the interior region of the enclosed area with a region exterior to the interior region of the confined area in order to expel air from the enclosed area. The purging door 42 is preferably disposed at a portion of the confined space which is substantially coincident with the location where air collects once the non-combustible gas from container 24 is introduced in the confined space. Therefore, if the non-combustible gas is lighter than the air present in the confined space, the purging door 42 should be located at least proximate the bottom of the confined space. However, if the non-combustible gas is heavier than the air present in the confined space, then the purging door should be located at least proximate the top of the confined space.

The system of the present invention is utilized for quickly extinguishing a fire which may be present in a substantially confined (i.e., airtight) space, such as the cargo area of an aircraft or a computer room. The system thus includes a fire detector 12 (such as ionizing smoke detectors) for detecting the presence of a fire within the confined space. If a fire is detected, relay 14 activates solenoid valve 18 to release the non-combustible gas which is preferably lighter than air, such as helium, in the enclosed area (preferably at an upper portion thereof). The accumulation of the non-combustible gas at the top portion of the enclosed area displaces the air present at the top portion of the enclosed area forcing the air present in the enclosed area in a downward direction toward the bottom of the enclosed area. After a predetermined period of time counted by timer 38 (for example, ten seconds) which depends upon the rate at which the non-combustible gas accumulates at the top portion of the enclosed area, a signal is sent from timer 38 to activate motor 40 to open purging door 42 at the bottom of the enclosed area causing the air (other than the non-combustible gas) to be expelled. The expulsion occurs due to a pressure differential between the inside of the space and an exterior area of the space caused by the introduction of the non-combustible gas. The door will remain open for a time to permit expulsion of the air. The purging door preferably remains open to expel a sufficient amount of air such that the fire cannot be sustained. The purging door is then closed. In the preferred embodiment, at about the same time that the purging door is closed, timer 38 sends a signal to solenoid valve 20 such that the fire extinguishing mixture stored in container 28 is expelled from the container and dispersed by misting nozzles 34 to the enclosed area to assist in extinguishing the fire and preventing a re-ignition. When a sensor (not shown) indicates that the concentration of non-combustible gas has reached a point that a fire could not be sustained (e.g., 30% helium), solenoid valve 18 suspends the flow of non-combustible gas to the enclosed area. The fire extinguishing mixture is preferably released only after the purging door has been shut in order to prevent the fire extinguishing mixture from being expelled through the purging door.

In order to insure that persons who access the enclosed area will not be exposed to harmful levels of the non-combustible gas, after the fire has been extinguished, the non-combustible gas may be removed from the enclosed area (via, for example forced venting with a fan) or is diluted with atmospheric air.

In an alternative embodiment of the invention, the purging door is activated by a pressure sensor. When the system is used on an aircraft, an altimeter (not shown) is coupled to the pressure sensor to account for pressure differences due to altitude which, depending upon the altitude of the aircraft (and the corresponding air pressure in the enclosed area as a result of the altitude) and the volume of non-combustible gas introduced into the enclosed area, the pressure sensor will activate the purging door to enable the air to exit the enclosed area.

In a further alternative embodiment of the invention, the non-combustible gas could be heavier than the air present in the enclosed area. In such a case, the air within the enclosed area would be displaced from the bottom of the enclosed area and forced upward. In this embodiment, the purging door would preferably be positioned in an upper region of the compartment. It is foreseen that the fire extinguishing mixture may not be needed to be introduced to the enclosed area if the concentration of the non-combustible gas is high enough to expel the fire and prevent re-ignition. It is foreseen that many non-combustible gases which do not support fire can be used such as nitrogen, helium, neon, argon, xenon, carbon dioxide and the like.

It is also foreseen that the present invention could be used in any substantially enclosed space, even an office where the windows and door are closed.

Other suitable fire extinguishing agents for use in the present invention include PURPLE K™ powder which is a potassium bicarbonate base dry chemical and those fire extinguishing agents disclosed in U.S. Pat. No. 4,756,839 (Curzon et al), the disclosure of which is incorporated herein by reference.

These and other changes of a similar nature are readily apparent to anyone with ordinary skill in the art and, as such, are intended to fall within the scope of the present invention as defined by the following claims.

What is claimed is:

1. A method of suppressing a fire present in an enclosed space containing air comprising the steps of:

a) detecting the presence of the fire in the enclosed space;

b) introducing a non-combustible gas into the enclosed space at a pressure greater than the air in the enclosed space so as to force air present in the enclosed space toward a first end of the enclosed space; and c) expelling the air other than the non-combustible gas from the first end of the enclosed space.

2. The method of suppressing a fire according to claim 1, further comprising the step of:

introducing a fire-extinguishing mixture into the enclosed space after the non-combustible gas has been introduced thereto.

3. The method of suppressing a fire according to claim 1, further comprising the step of:

introducing a fire extinguishing mixture consisting of fire-extinguishing agent and a second non-combustible gas into the enclosed area after the non-combustible gas has been introduced thereto.

4. The method of suppressing a fire according to claim 1, further comprising the step of:

introducing a fire extinguishing mixture into the enclosed space after a supply of the non-combustible gas has been exhausted and after the air has been expelled from the enclosed space.

5. The method of suppressing a fire according to claim 1, wherein step c) comprises:

opening a gas purging door located at the first end of the enclosed space.

6. The method of suppressing a fire according to claim 5, further comprising:

closing the gas purging door after a predetermined period of time; and introducing a fire extinguishing mixture into the enclosed space.

7. A fire suppression system for an enclosed space comprising:

a fire detector for detecting the presence of a fire in the enclosed space;

a container for storing a non-combustible, non-reactive gas which will not support combustion;

a valve fluidly coupled to the container, the valve being responsive to the fire detector for releasing the non-combustible gas from said container and introducing the non-combustible gas to the enclosed space when a fire is detected in the enclosed space; and a selectably openable gas purging door for permitting the expulsion of gases other than the non-combustible gas from the enclosed space, wherein the non-combustible gas is introduced to the enclosed space with a pressure that is greater than a pressure of the gases in the enclosed space to force expulsion of the gases other than non-combustible gas from the enclosed space through the gas purging door.

8. The fire suppression system of claim 7, further comprising:

a venting manifold in fluid communication with the valve, the venting manifold having a vent hole in fluid communication with the enclosed space, the venting manifold receiving the non-combustible gas released by the valve from the container and providing the non-combustible gas to the vent hole for introduction to the enclosed space.

9. The fire suppression system of claim 7, wherein the non-combustible gas is heavier than air such that, when introduced into the enclosed space, the non-combustible gas collects at a bottom portion of the enclosed space displacing air present at the bottom of the enclosed space and forcing the air toward an upper portion of the enclosed space;

and wherein the gas purging door is positioned at the upper portion of the enclosed space for removing the air present at the upper portion of the enclosed space.

10. The fire suppression system of claim 7, wherein the non-combustible gas is lighter than air such that, when introduced into the enclosed space, the non-combustible gas collects at an upper portion of the enclosed space displacing air present at the upper portion of the enclosed space and forcing the air toward a lower portion of the enclosed space;

and wherein the gas purging door is positioned at the lower portion of the enclosed space for removing the air present at the lower portion of the enclosed space.

11. The fire suppression system of claim 7, wherein said valve is a solenoid valve.

12. The fire suppression system of claim 7, further comprising:

a relay operatively coupled between the valve and the fire detector, the relay being responsive to the fire detector and providing a signal to the valve to release the non-combustible gas from the container to the enclosed space.

13. The fire suppression system of claim 12, further comprising:

a timer operatively coupled to the relay and the gas purging door, the timer being responsive to a signal provided by the relay after a fire is detected and providing a signal to the gas purging door for opening the same after a predetermined period of time has elapsed after a fire is detected.

14. The fire suppression system of claim 7, wherein said fire detector is an ionizing smoke detector.

15. The fire suppression system of claim 7, wherein the non-combustible gas is stored in the container under a positive pressure.

16. The fire suppression system of claim 7, further comprising:

a second container for holding a fire extinguishing mixture; and a second valve for releasing the fire extinguishing mixture from said second container after said fire detector detects the presence of a fire.

17. The fire suppression system of claim 16, wherein the fire extinguishing mixture comprises a fire extinguishing agent and a second non-combustible, non-reactive gas which will not support combustion.

18. The fire suppression system of claim 17, wherein the second non-combustible gas is the same as the non-combustible gas.

19. The fire suppression system of claim 17, wherein the second non-combustible gas is a non-reactive gas which will not support combustion.

20. The fire suppression system of claim 16, further comprising:

a misting nozzle manifold in fluid communication with the second valve, the misting nozzle manifold having a misting nozzle in fluid communication with enclosed space, the misting nozzle manifold receiving the fire extinguishing mixture released by the second valve from the second container and providing the fire extinguishing mixture to the misting nozzle for introduction to the enclosed space.

21. The fire suppression system of claim 20, wherein the misting nozzle manifold is located at an upper region of the enclosed space.

22. The fire suppression system of claim 7, wherein the non-combustible gas is selected from the group consisting of helium, neon, argon, xenon, carbon dioxide and nitrogen.

* * * * *